US010105834B2

(12) United States Patent
Hamm et al.

(10) Patent No.: US 10,105,834 B2
(45) Date of Patent: Oct. 23, 2018

(54) ADAPTERS FOR CHAIN PIPE VISES

(71) Applicant: Ridge Tool Company, Elyria, OH (US)

(72) Inventors: James E. Hamm, Grafton, OH (US); Harald Krondorfer, Aurora, OH (US); Michael J. Rutkowski, Brunswick, OH (US); Jeffrey Szucs, Akron, OH (US)

(73) Assignee: RIDGE TOOL COMPANY, Elyria, OH (US)

( * ) Notice: Subject to any disclaimer, the term of this patent is extended or adjusted under 35 U.S.C. 154(b) by 284 days.

(21) Appl. No.: 14/935,524

(22) Filed: Nov. 9, 2015

(65) Prior Publication Data

US 2017/0129094 A1 May 11, 2017

(51) Int. Cl.

| | |
|---|---|
| ***B25B 1/00*** | (2006.01) |
| ***B25H 1/00*** | (2006.01) |
| ***B25B 1/20*** | (2006.01) |
| ***B25B 1/24*** | (2006.01) |

(52) U.S. Cl.

CPC ..... *B25H 1/005* (2013.01); *B25B 1/205* (2013.01); *B25B 1/2457* (2013.01)

(58) Field of Classification Search

CPC .... B25B 1/00; B25B 1/02; B25B 1/04; B25B 1/20; B25B 3/00; B25B 5/00; B25B 11/00

See application file for complete search history.

(56) References Cited

U.S. PATENT DOCUMENTS

| | | | | |
|---|---|---|---|---|
| 979,305 | A * | 12/1910 | Hunt | B25B 1/20 269/172 |
| 1,084,130 | A * | 1/1914 | Gargin | B25B 5/006 269/45 |
| 1,103,243 | A | 7/1914 | Amborn | |
| 1,158,414 | A | 10/1915 | Amborn | |
| 1,653,326 | A | 12/1927 | Welter | |
| 1,807,917 | A | 6/1931 | Jones | |
| 2,394,709 | A | 2/1946 | Matter | |
| 4,943,039 | A * | 7/1990 | Jackson | B25B 5/006 269/45 |
| 5,330,167 | A * | 7/1994 | Plumb | B25B 1/06 269/153 |
| 6,073,919 | A | 6/2000 | Hammit et al. | |
| 6,089,554 | A * | 7/2000 | Berardino | B25B 5/006 269/130 |
| 6,382,610 | B1 | 5/2002 | Corbin | |

(Continued)

FOREIGN PATENT DOCUMENTS

| | | | |
|---|---|---|---|
| CN | 2106684 | U | 6/1992 |
| CN | 102581454 | A | 7/2012 |

(Continued)

OTHER PUBLICATIONS

Office Action issued by GPTO dated Oct. 18, 2017; Application 102016221865.4; 3 pages.

(Continued)

*Primary Examiner* — Lee D Wilson

(74) *Attorney, Agent, or Firm* — Mark E. Bandy; Rankin, Hill & Clark LLP

(57) ABSTRACT

Adapters are described which enable a wide array of tools to be secured and/or mounted in a chain pipe vise. Also described are methods of using adapters with chain pipe vises in order to stably mount tools in the chain pipe vise.

8 Claims, 12 Drawing Sheets

(56) References Cited

U.S. PATENT DOCUMENTS

| | | | | |
|---|---|---|---|---|
| 7,445,184 | B1 * | 11/2008 | Johnson | B05B 13/0285 248/176.1 |
| 8,590,876 | B1 | 11/2013 | Madson | |
| 8,601,855 | B1 * | 12/2013 | Hamm | B25B 1/205 269/131 |
| 8,777,205 | B2 | 7/2014 | Hamm et al. | |
| 8,967,606 | B2 * | 3/2015 | Hamm | B25H 1/06 269/130 |
| 2006/0090620 | A1 | 5/2006 | Leberfinger et al. | |
| 2008/0029662 | A1 | 2/2008 | O'Rourke | |
| 2010/0269649 | A1 | 10/2010 | Rantz | |
| 2012/0175833 | A1 * | 7/2012 | Hamm | B25B 1/205 269/266 |
| 2012/0175834 | A1 * | 7/2012 | Hamm | B23K 37/006 269/293 |
| 2015/0040731 | A1 | 2/2015 | Moherman et al. | |
| 2017/0129094 | A1 * | 5/2017 | Hamm | B25B 1/205 |

FOREIGN PATENT DOCUMENTS

| | | | |
|---|---|---|---|
| CN | 102581831 | A | 7/2012 |
| DE | 3783980 | T | 8/1993 |
| GB | 414969 | A | 8/1934 |
| WO | WO 2005023482 | | 3/2005 |

OTHER PUBLICATIONS

Search Report dated Jan. 17, 2018; Application 201610528778.9; 2 pages.

* cited by examiner

ADAPTERS FOR CHAIN PIPE VISES

FIELD

The present subject matter relates to adapters for supporting a variety of tools with chain pipe vises.

BACKGROUND

Applications arise when it is desirable or necessary to stably mount a tool for subsequent use of the tool. In some cases, this need results from the tool having been designed to be mounted prior to tool use, such as for example when a workpiece is brought to the tool. In other cases, a tool can be used both in handheld and mounted configurations, such as for example when the tool is brought to the workpiece and vice versa.

Pipe working professionals typically have a chain pipe vise available when working with pipe. A chain pipe vise provides a stable mounting point for pipe and conduit for example. However, chain pipe vises are specifically designed to hold pipes and similarly shaped workpieces. In order to stably mount tools, various work stands or portable work benches are typically used. Although use of such stands and benches is generally acceptable for work performed in a shop or other designated facility; for work performed in the field or at a jobsite, it is undesirable to transport and set up additional stands or benches.

Accordingly, a need exists for a strategy by which a chain pipe vise, which is often present or used by those at jobsites, can be used to stably mount or support tools or other objects besides pipes, conduits, or workpieces.

SUMMARY

The difficulties and drawbacks associated with previous approaches are addressed in the present subject matter as follows.

In one aspect, the present subject matter provides an adapter for mounting a tool to a chain vise. The adapter comprises a stanchion defining a first end and a second opposite end. The adapter also comprises at least one support, each support extending laterally outward from the stanchion. Each support defines a distal end. The stanchion is sized and shaped to be received and engaged with the chain vise. The support(s) are sized and oriented to receive a tool for mounting to the adapter which is mounted to the chain vise.

In another aspect, the present subject matter provides an adapter for mounting a tool to a chain vise. The adapter comprises a stanchion defining a first end and a second opposite end. The adapter also comprises at least one leg extending outward from the stanchion. And, the adapter comprises a key extending outward from the stanchion. The stanchion is sized and shaped to be received and engaged with the chain vise. And the at least one leg is configured to contact a support surface associated with the chain vise.

In still another aspect, the present subject matter provides a method of mounting a tool in a chain vise. The method comprises providing an adapter including (i) a stanchion defining a first end and a second opposite end, (ii) at least one support, each support extending laterally outward from the stanchion, and (iii) optionally, at least one coupling, each optional coupling engaged with the support. The stanchion is sized and shaped to be received and engaged with the chain vise, and the supports and optional couplings are sized and oriented to receive a tool for mounting to the chain vise.

The method also comprises providing a chain vise including (i) a V-shaped support, (ii) a chain, and (iii) a chain tightening assembly. The method further comprises positioning the adapter on the V-shaped support, positioning the chain around the stanchion of the adapter, tightening the chain positioned around the stanchion, positioning a tool to be mounted in the chain vise on the at least one support of the adapter, and engaging at least one of the support and the optional coupling with the tool to thereby mount the tool in the chain vise.

In yet another aspect, the present subject matter provides a method of mounting a tool in a chain vise. The method comprises providing an adapter including (i) a stanchion defining a first end and a second opposite end, (ii) at least one leg extending outward from the stanchion, and (iii) a key extending outward from the stanchion. The stanchion is sized and shaped to be received and engaged with the chain vise, and the leg is configured to contact a support surface associated with the chain vise. The method also comprises providing a chain vise including (i) a V-shaped support, (ii) a chain, and (iii) a chain tightening assembly. The method additionally comprises positioning the adapter on the V-shaped support. The method further comprises positioning the chain around the stanchion of the adapter. And, the method comprises tightening the chain positioned around the stanchion. The method also includes positioning a tool to be mounted in the chain vise, on the adapter. And, the method additionally includes engaging the adapter with the tool to thereby mount the tool in the chain vise.

As will be realized, the subject matter described herein is capable of other and different embodiments and its several details are capable of modifications in various respects, all without departing from the claimed subject matter. Accordingly, the drawings and description are to be regarded as illustrative and not restrictive.

DETAILED DESCRIPTION OF THE EMBODIMENTS

Figure 1:
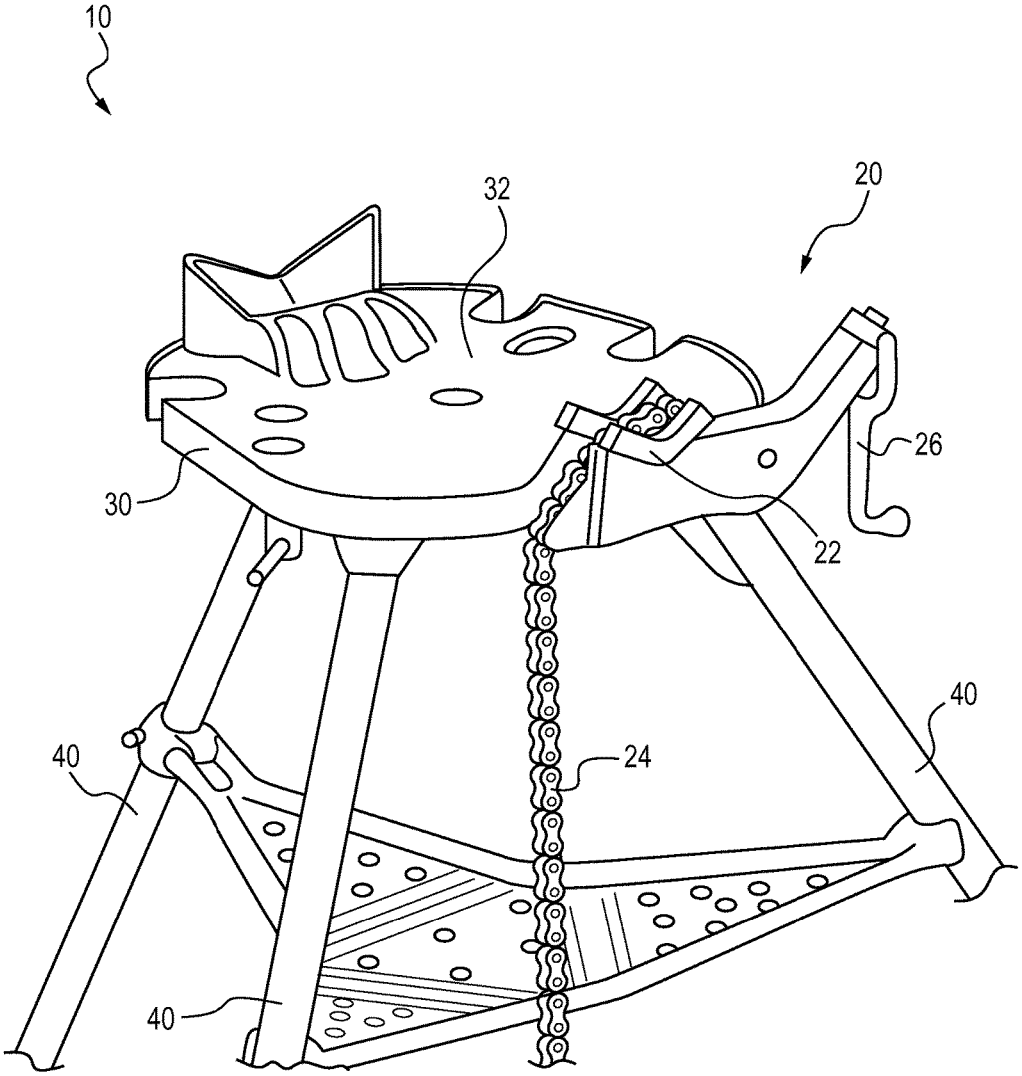
FIG. 1 is an illustration of a typical TRISTAND chain vise, with which the present subject matter adapters can be used.

The present subject matter relates to the use of chain pipe vises as mounting supports for a variety of tools. Chain pipe vises are primarily used by plumbers, pipefitters, electricians, and others who typically work with pipe, tubular components or workpieces. The present subject matter also relates to adapters used with chain pipe vises to enable certain tools to be affixed to the vise. This results in eliminating the need for a separate or specific stand. The present subject matter further relates to the use of adapters and/or tools in conjunction with chain pipe vises. The present subject matter, i.e., the various method(s) and adapter(s), provides numerous benefits which include the following.

A user can utilize a chain vise they already have to secure and/or support their various tools in place. Thus, the user does not have to buy or otherwise obtain a dedicated stand that takes up additional space as compared to the adapters of the present subject matter.

With handheld tools, the tool can be mounted for bench use. The present subject matter adapters positively locate the tool in the vise. In many embodiments, the adapter engages with the chain vise in only a single orientation, to thereby promote repeatable and stable affixment of a tool.

The configuration of the adapter can be modified for use with a variety of tools, including geared threaders and beveling tools, other types of vises, benders, cutters, press and crimp tools, punches, saws, etc.

Using the adapter to mount a tool may allow the tool to be used in a different manner, change or increase capacity, and potentially increase productivity through ease of material handling, etc. For example, with a beveling tool, mounting the beveller as described herein allows much shorter workpieces to be beveled and reduces handling time. For a geared threader, mounting the threader thereby enables the threader to be used with a rotating pipe. Using the adapter to mount a tool can change the way that the tool is used. For example, the tool may typically be brought to the workpiece in normal use, while use of a fixed or mounted tool allows the workpiece to be brought to the tool.

Chain Pipe Vises

The present subject matter adapters and related methods, are utilized with a wide array of chain pipe vises (or periodically referred to herein as "chain vises"). Chain pipe vises are well known in the art and described in U.S. Pat. Nos. 1,103,243; 1,807,917; 1,158,414; 1,653,326; 6,073,919; and 6,382,610 for example. Chain vises adapted for mounting on a bench or other component are well known and commercially available such as Bench Chain Vises available from RIDGID such as Model Nos. BC210, BC410, BC210P, BC410P, BC510, BC610, BC810, BC2A, and BC4A. Stand Chain Vises are also available from RIDGID as Model No. 560. Chain vises incorporated in a work stand referred to as a TRISTAND are also available from RIDGID as Model Nos. 425, 460-6, and 460-12.

Chain pipe vises are typically characterized by and include a V-shaped support upon which a pipe or workpiece is positioned for subsequent affixment, a chain which is typically a roller chain that is placed over the workpiece to be affixed, and a chain tightening assembly.

Most chain pipe vises are designed for use such that the V-shaped support is directed vertically upwards. Thus, upon placing a workpiece on the support, the weight of the workpiece keeps the workpiece centered within the V-shaped support. However, the present subject matter is not limited to such uses or orientations and thus includes uses with chain pipe vises that are directed along other angles or orientations besides vertical.

Adapters

The adapters of the present subject matter generally comprise a central or primary stanchion member that is sized and/or shaped to be received within and engaged with a chain pipe vise. In many embodiments, the stanchion is cylindrical and may include a hollow interior extending between opposite ends of the stanchion and be in a variety of forms such as for example a steel tube. However, the stanchion may exhibit a variety of other cross sectional shapes besides a circular cross section. The stanchion may also be nonsymmetrical or irregular in shape.

The adapter also comprises one or more supports that extend outward and in many embodiments, laterally outward from the stanchion. The supports can be permanently formed with the stanchion and/or releasably affixed thereto, such as by using threaded fasteners. In many versions, one or more of the support includes an adjustable coupling at or near a distal end of the support. In particular embodiments, each support includes an optional adjustable coupling at its distal end. The supports and their corresponding couplings are sized and oriented to receive a tool to be mounted in the chain vise of interest. The various adapters may optionally include one or more leg(s) and key(s). These aspects are described in greater detail herein.

It is also contemplated that the adapters of the present subject matter could be incorporated within or integrally formed with a stand or other component. It is also contemplated that the adapters could be incorporated in a tool or tool system. For example, an adapter or its components could be integrally formed in a tool. Thus, it will be understood that the adapters of the present subject matter can be provided in a variety of different forms and configurations.

Methods

The methods of the present subject matter generally relate to affixment and mounting various tools in chain pipe vises using the adapters of the present subject matter. The methods typically comprise providing an adapter in accordance with the present subject matter. The adapter can be in the form of the embodiments described herein or can be in a variety of other forms. The methods also comprise positioning the adapter in the chain pipe vise such that a stanchion member of the adapter is positioned on the V-shaped support of the vise and particularly centrally located and extending parallel or collinearly with a center axis of the V-shaped support. Upon appropriate positioning of the stanchion on the V-shaped support such that the optional adjustable couplings can be accessed and engaged with a tool subsequently positioned on the adapter, the chain of the chain pipe vise is positioned around the stanchion and tightened to thereby engage and affix the adapter to the chain pipe vise. It will be understood that if couplings are not used, the tool can be engaged with one or more of the supports. Thus, the support(s) are positioned to be accessible. After such engagement and affixment of the adapter, a tool to be mounted on the adapter is placed on the adapter. The supports and/or optional couplings are then engaged with the tool and typically along one or more lower regions of the tool. The couplings are tightened to thereby affix and mount the tool to the adapter and chain pipe vise. The present subject matter also includes performing these operations in a different sequence or order. For example, the tool can be mounted on the adapter, and then the adapter engaged and affixed to the chain pipe vise.

Generally, regardless of the mounting configuration, the adapter is positioned within the V-shaped support of the vise. The optional one or more leg(s) assist and/or preclude rotation of the adapter positioned on the V-shaped support.

The adapter is also aligned along its length direction, i.e., a central axis of the adapter, and relative to the V-shaped support by the optional one or more key(s).

For versions of the adapter which include one or more legs extending from the stanchion, the methods also include contacting the legs with a support surface associated with the vise. If the chain pipe vise is incorporated in a TRI-STAND or other stand chain vise, the support surface is typically a work surface of a base plate of the TRISTAND or other stand. If the chain pipe vise is in the form of a bench chain vise, the support surface is typically a surface of the bench, other work surface, or the base of the vise. The leg(s) contact the support surface to "time" or ensure appropriate rotational position of the adapter relative to the vise.

For versions of the adapter which include a key extending from the stanchion, and when using the adapter with a chain pipe vise having a V-shaped support having a pair of spaced apart, co-extending legs, the methods also include disposing or positioning the key between the spaced apart legs within a space between such legs. This promotes stability of the adapter within the V-shaped support. It will be appreciated that use of one or more key(s) in the present subject matter adapters may be useful for engagement with other vise configurations including those that do not include pair(s) of spaced apart legs. That is, the key(s) serve to positively axially locate the adapter relative to the vise. Typically, this is performed by positioning the adapter on the V-shaped support until the key contacts the V-shaped support or another region of the chain vise or stand for example. That is, in many embodiments of the present subject matter, the key extends outwardly from the stanchion such that upon proper axial placement of the adapter relative to the chain vise, the key contacts the chain vise. It is contemplated that a wide array of outwardly projecting or extending member(s) could be used for the key(s) noted herein. For example, in certain embodiments, the key is in the form of a plate or rigid member that contacts the chain vise, components thereof such as the V-shaped support, and/or a work stand having a chain vise, to thereby axially locate the adapter.

Tools

A wide array of tools can potentially be stably mounted and/or secured in chain pipe vises using the present subject matter adapters and methods. For example, beveling machines and devices such as a B-500 Transportable Pipe Beveller from Ridge Tool and beveling tools described in US 2015/0040731 for example can be mounted. Various power threading tools such as hand-held power drives and larger power threading machines can also be used with the adapters of the present subject matter. The power drives can be in the form of various commercially available power drives from Ridge Tool such as 600-I Power Drive, 690-I Power Drive, and 700 Power Drive. The present subject matter includes the use of other power drives besides these. The present subject matter can also be used with groovers and more particularly pipe groovers. A variety of pipe groovers could potentially be used with the adapters such as for example a 915 Roll Groover available from Ridge Tool. The present subject matter includes the use of other groovers.

FIG. 1 illustrates a TRISTAND chain vise 10. The TRI-STAND chain vise 10 includes a chain pipe vise 20 having a V-shaped support 22, a chain 24, and a chain tightening assembly 26. The TRISTAND chain vise 10 also includes a base plate 30 defining a work surface 32, and a plurality of legs 40.

Figure 2:
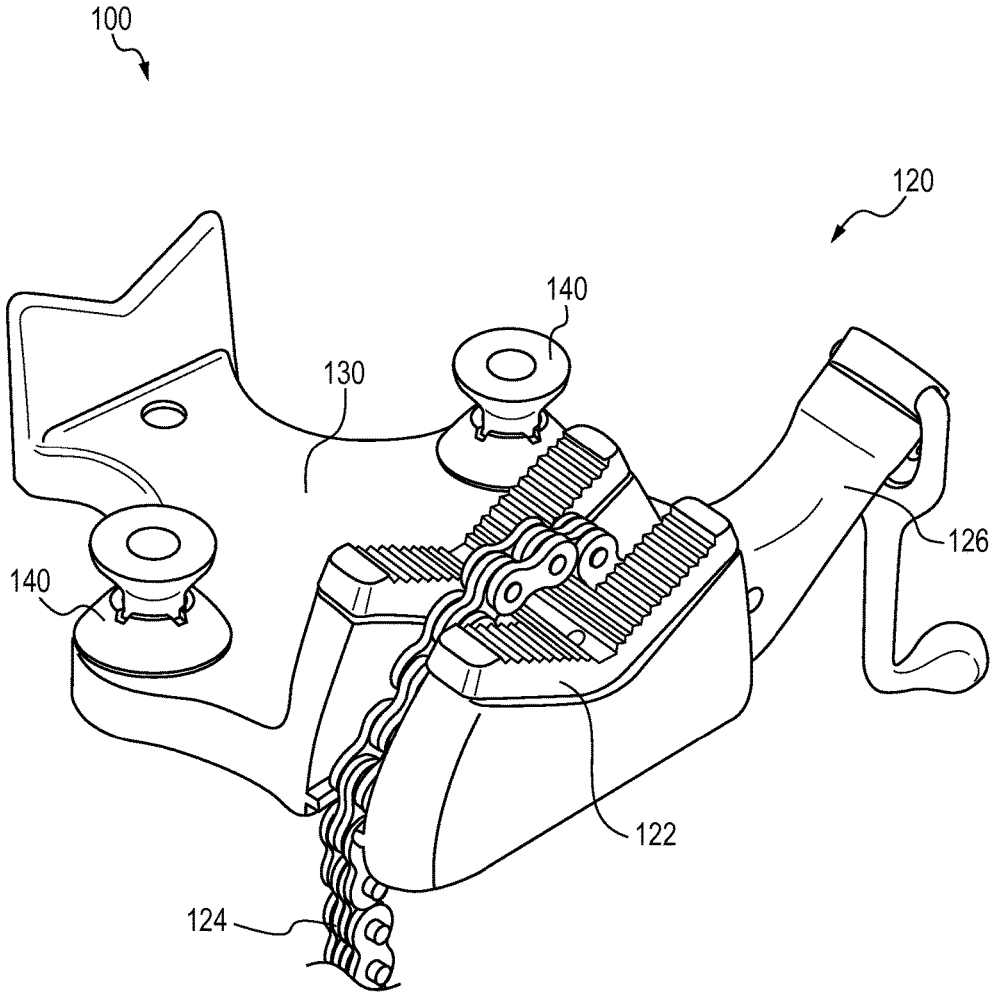
FIG. 2 is an illustration of a typical bench chain vise, with which the present subject matter adapters can be used.

FIG. 2 illustrates a bench chain vise 100 including a chain pipe vise 120 having a V-shaped support 122, a chain 124, and a chain tightening assembly 126. The bench chain vise 100 typically includes a frame 130 and provisions 140 for mounting or engaging the vise 120 with a substrate or work surface for example.

Figure 3:
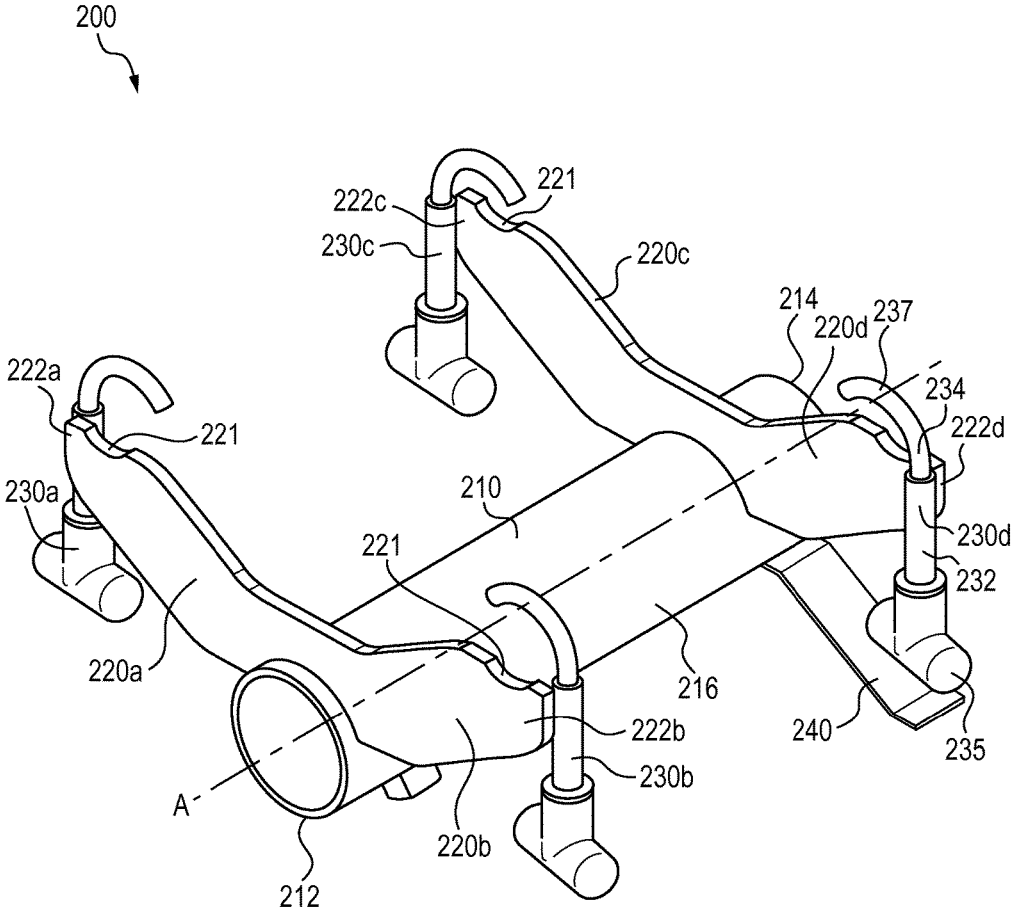
FIG. 3 is a perspective illustration of an embodiment of an adapter for mounting a tool in a chain vise in accordance with the present subject matter.

FIG. 3 is an illustration of an embodiment of an adapter 200 in accordance with the present subject matter. The adapter 200 comprises a stanchion 210 defining a first end 212, a second opposite end 214, and an exterior surface 216. The stanchion 210 may define one or more interior hollow regions. In certain embodiments, the hollow region(s) extend between the ends 212 and 214. The adapter 200 also comprises at least one, and more particularly, a plurality of supports 220 extending outward from the stanchion 210. In the particular embodiment shown in FIG. 3, the adapter 200 comprises four supports shown as 220*a*, 220*b*, 220*c*, and 220*d*. In many embodiments, the supports 220 extend laterally outward from the stanchion 210, and in particular embodiments the supports 220 extend outward at right angles or substantially so to a center axis of the stanchion 210 shown in FIG. 3 as axis A. Upon positioning the adapter 200 in a chain pipe vise, in certain embodiments the supports extend upward or upward at an angle or inclination.

The plurality of supports 220 can be arranged in various configurations relative to the stanchion 210. Any number of supports could be used such as from one to ten or more. Four is useful for many embodiments. In the particular embodiment of FIG. 3, a first pair of supports 220*a* and 220*b* are located proximate the first end 212 of the stanchion, and a second pair of supports 220*c* and 220*d* are located proximate the second end 214 of the stanchion. The supports 220 can be arranged relative to each other in numerous configurations. However, in many embodiments the supports are arranged in pairs, each support extending in an opposite direction from its corresponding support of the pair. In certain embodiments, one or more recessed or nested receiving regions 221 can be defined on one or more of the supports 220, and particularly along upwardly directed surfaces of the supports 220. The receiving regions 221 receive and contact portions of tools to be mounted on the adapter 200.

The adapter 200 also comprises one or more adjustable couplings 230 for releasable affixment with a tool. In the version of the adapter 200 shown in FIG. 3, the adapter 200 includes a plurality of adjustable couplings 230*a*, 230*b*, 230*c*, and 230*d*. Each coupling is engaged at a distal end 222 of a support 220. Thus, the coupling 230*a* is engaged at an end 222*a* of the support 220*a*. The coupling 230*b* is engaged at an end 222*b* of the support 220*b*. The coupling 230*c* is engaged at an end 222*c* of the support 220*c*. And, the coupling 230*d* is engaged at an end 222*d* of the support 220*d*.

A variety of adjustable couplings can be used in the present subject matter adapters. In the version shown in FIG. 3, and as shown with reference to coupling 230*d* for example, each coupling 230 includes a threaded mount 232, and a linearly displaceable member 234 threadedly engaged with the mount. The linearly displaceable member 234 can include a handle portion 235 and an engagement end 237 for affixment to a tool of interest. Other couplings, clamps, or clamping assemblies could be used. For example, the present subject matter includes couplings that are free of threads or threaded members and can be in the form of a toggle clamp.

The adapter 200 may optionally comprise one or more legs 240 extending from the stanchion 210. Use of the legs 240 is described in greater detail herein. The leg(s) 240 typically extend outward from the center axis A of the stanchion 210 and in many embodiments, in a direction away from the supports 220. For example, if the supports extend upward, the legs typically extend downward or at an angle or downward inclination when the adapter is positioned in a chain pipe vise. The legs 240 may also serve to prevent inadvertent rotation of the adapter 200 about the center axis A of the stanchion 210.

Figure 4:
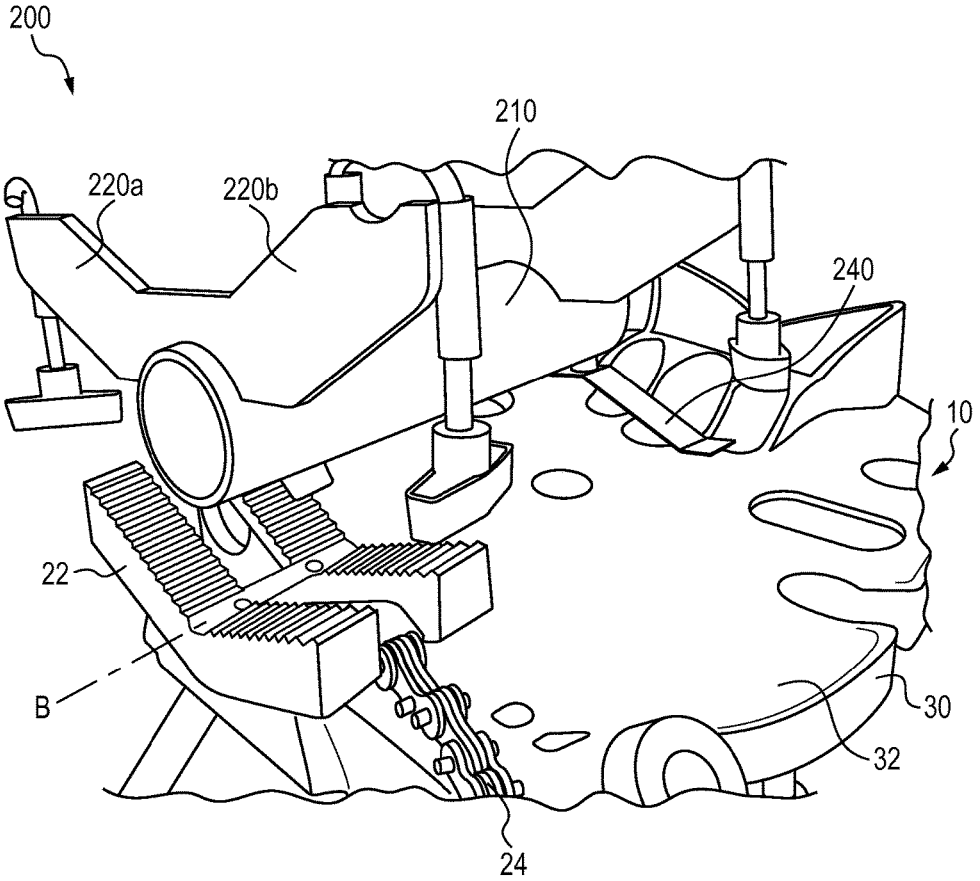
FIGS. 4-5 illustrate positioning the adapter depicted in FIG. 3 in a TRISTAND chain vise in accordance with an embodiment of the present subject matter.

FIG. 4 illustrates use of the adapter 200 depicted in FIG. 3 with the TRISTAND chain vise 10 illustrated in FIG. 1. Typically, use of the adapter involves positioning the adapter such as adapter 200 in the chain pipe vise such that the stanchion 210 is positioned on the V-shaped support 22 of the vise and is oriented such that the center axis A of the stanchion 210 is parallel or extending collinearly with a center axis of the V-shaped support, shown in FIG. 4 as axis B. The stanchion 210 is contacted with the V-shaped support 22. If the adapter includes legs 240, the legs 240 typically contact the work surface 32 of the base plate 30 (or equivalent surface). Depending upon the configuration of the TRISTAND or the stand chain vise, the stanchion 210 may also contact and rest upon another support besides support 22.

Figure 5:
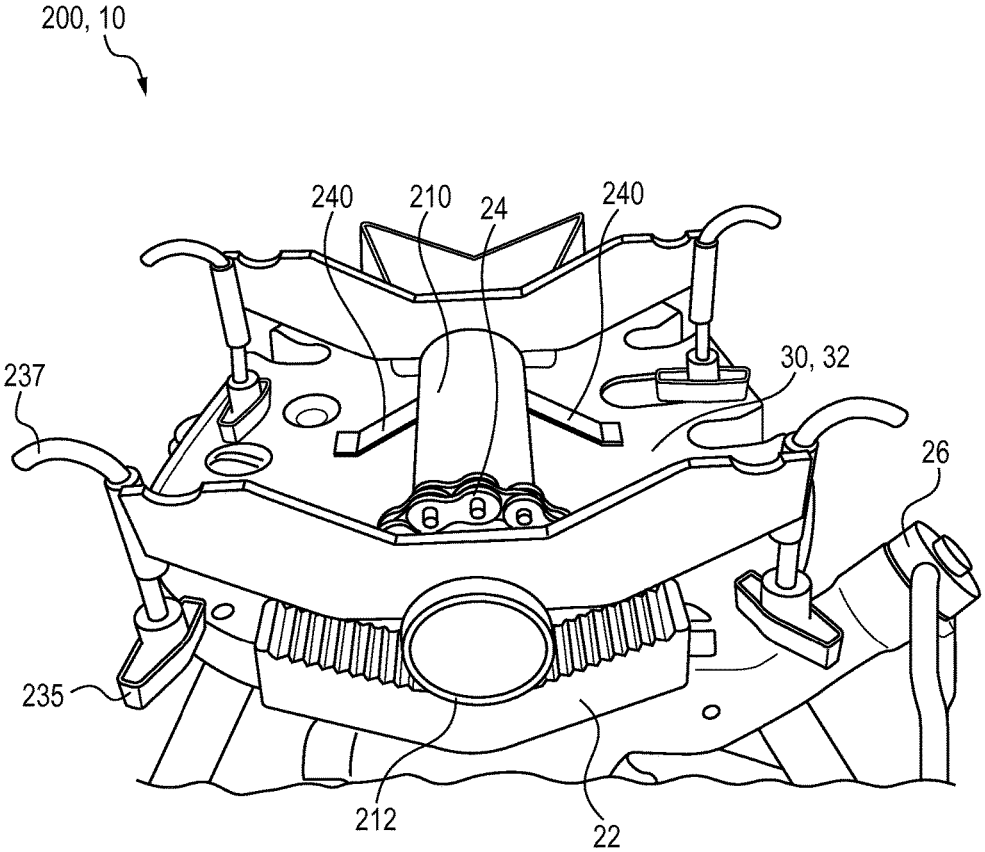

FIG. 5 illustrates further positioning and orienting the adapter 200 in the TRISTAND chain vise 10, and subsequent affixment of the adapter by wrapping the chain 24 around the stanchion 210 and then tightening the chain 24 using the chain tightening assembly 26. In this position and orientation, the legs 240 of the adapter 200 contact the work surface 32 of the base plate 30.

Figure 6:
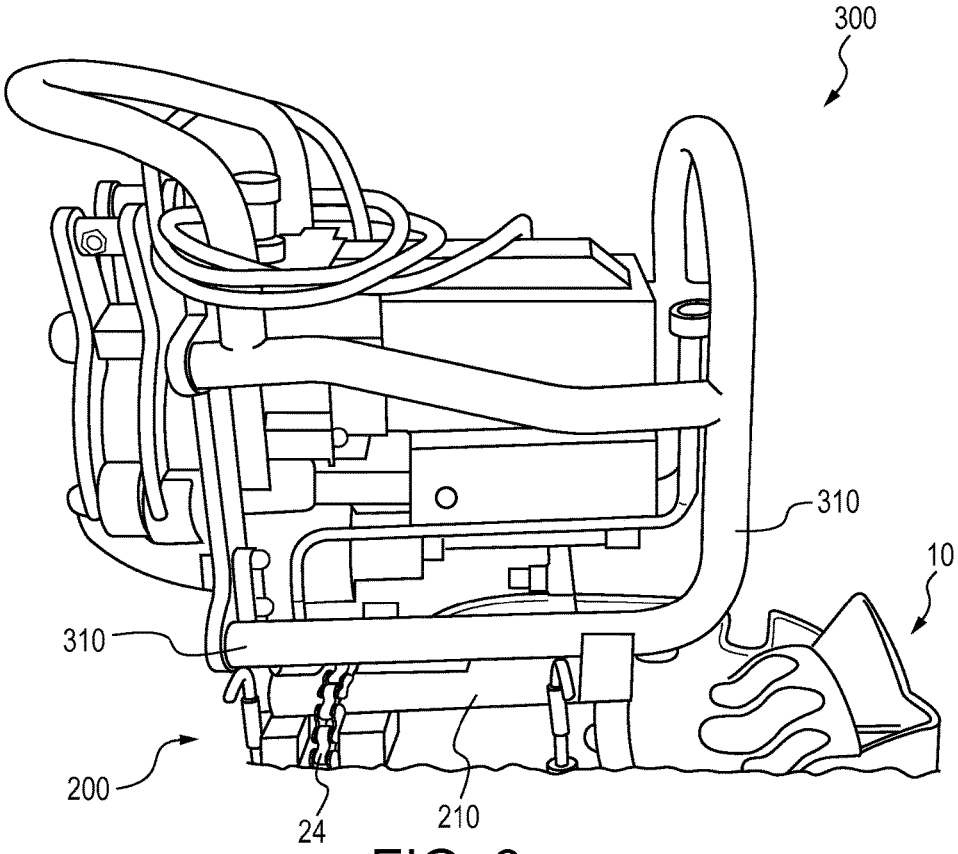
FIGS. 6-8 depict mounting a beveller tool on a TRISTAND chain vise using the adapter shown in FIG. 3.

FIG. 6 illustrates supporting and/or positioning a tool to be mounted on the adapter 200 after affixment to the TRISTAND chain vise 10. In this example, the tool is a portable beveling tool 300 having one or more outer frame members in the form of tubular supports 310 extending along a lower region of the tool 300. The tubular supports 310 are contacted with the supports 220 (not shown) of the adapter 200, and as described in greater detail herein, can be positioned within one or more nested receiving regions defined on upwardly directed surfaces of the supports 220. This aspect is described in greater detail with reference to FIGS. 7 and 8.

Figure 7:
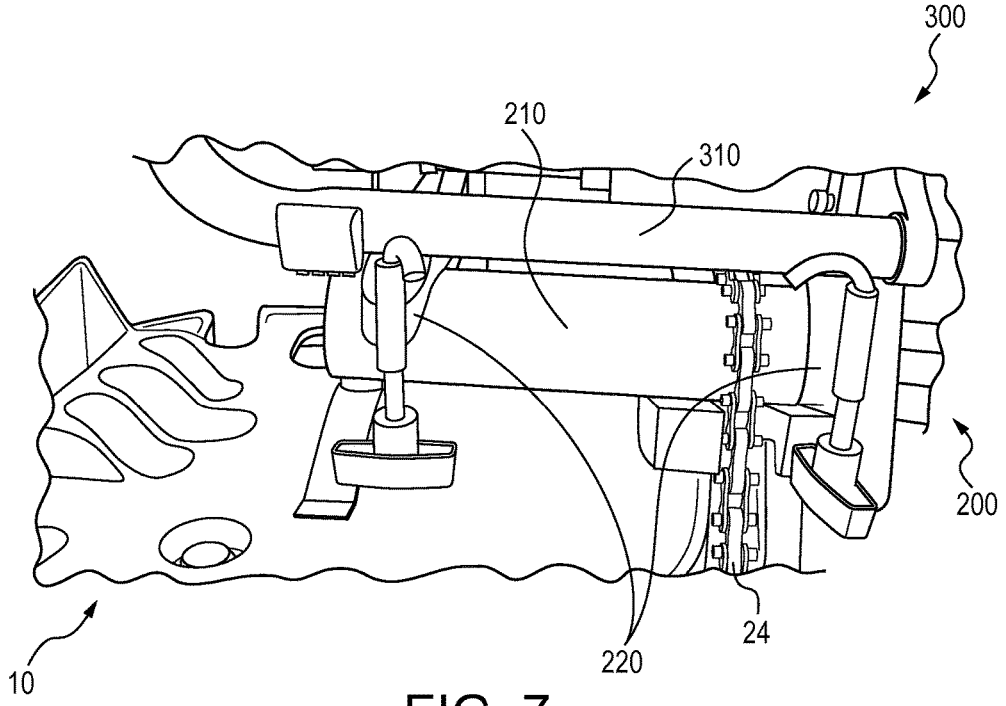

FIG. 7 is a detailed view further illustrating contact between supports 220 of the adapter 200 and the tubular supports 310 of the beveling tool 300. The adapter 200 is affixed to the TRISTAND chain pipe vise 10 by the chain 24 positioned about the stanchion 210 and placed under tension. The tubular supports 310 are disposed upon the supports 220 of the adapter 200, and in particular embodiments, are positioned within the receiving regions 221 defined in the supports 220 and shown in FIG. 3.

Figure 8:
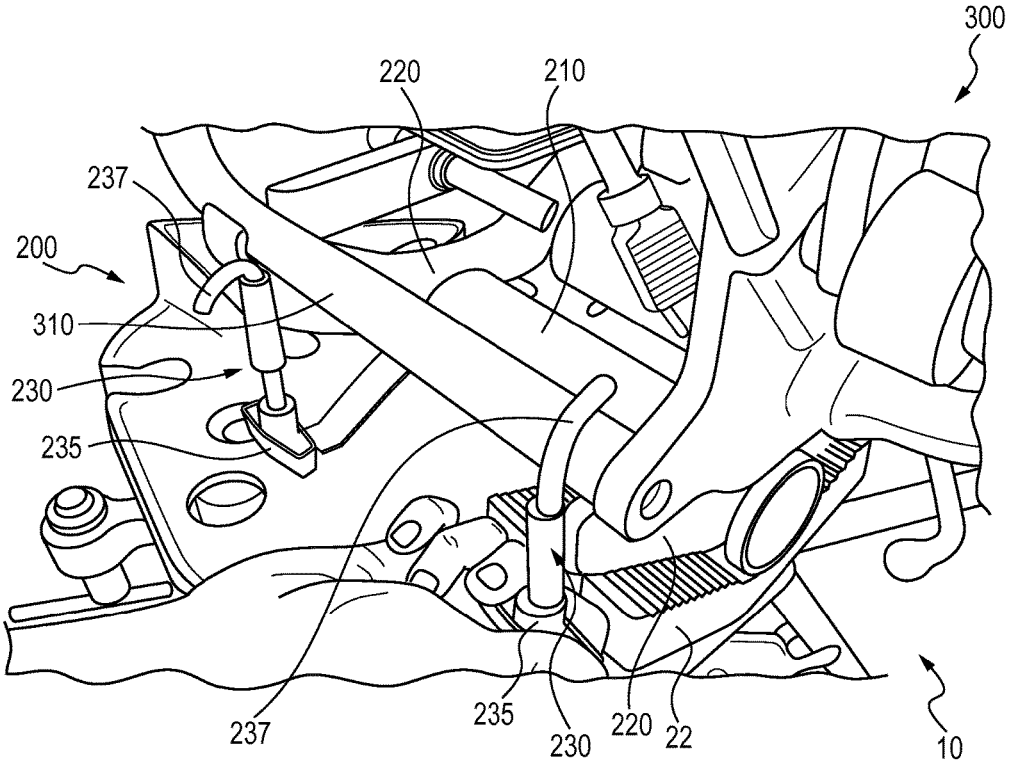

After appropriate positioning of the tool 300 on the adapter 200 affixed in the TRISTAND chain pipe vise 10, the adjustable couplings 230 are engaged with the tool 300. In many applications, the adjustable couplings 230 are engaged with a lower region of the tool such as portions of the tubular members 310. The adjustable couplings can be engaged with the tool by contacting or positioning an engagement end 237 over a portion of the tool 300 such as for example a tubular member 310 and then tightening the coupling 230 by rotating the handle portion 235 as shown in FIG. 8 for example. Upon appropriate engagement between the couplings 230 of the adapter 200 and the tool 300, the tool 300 is stably mounted and/or supported by the TRISTAND chain vise 10.

Figure 9:
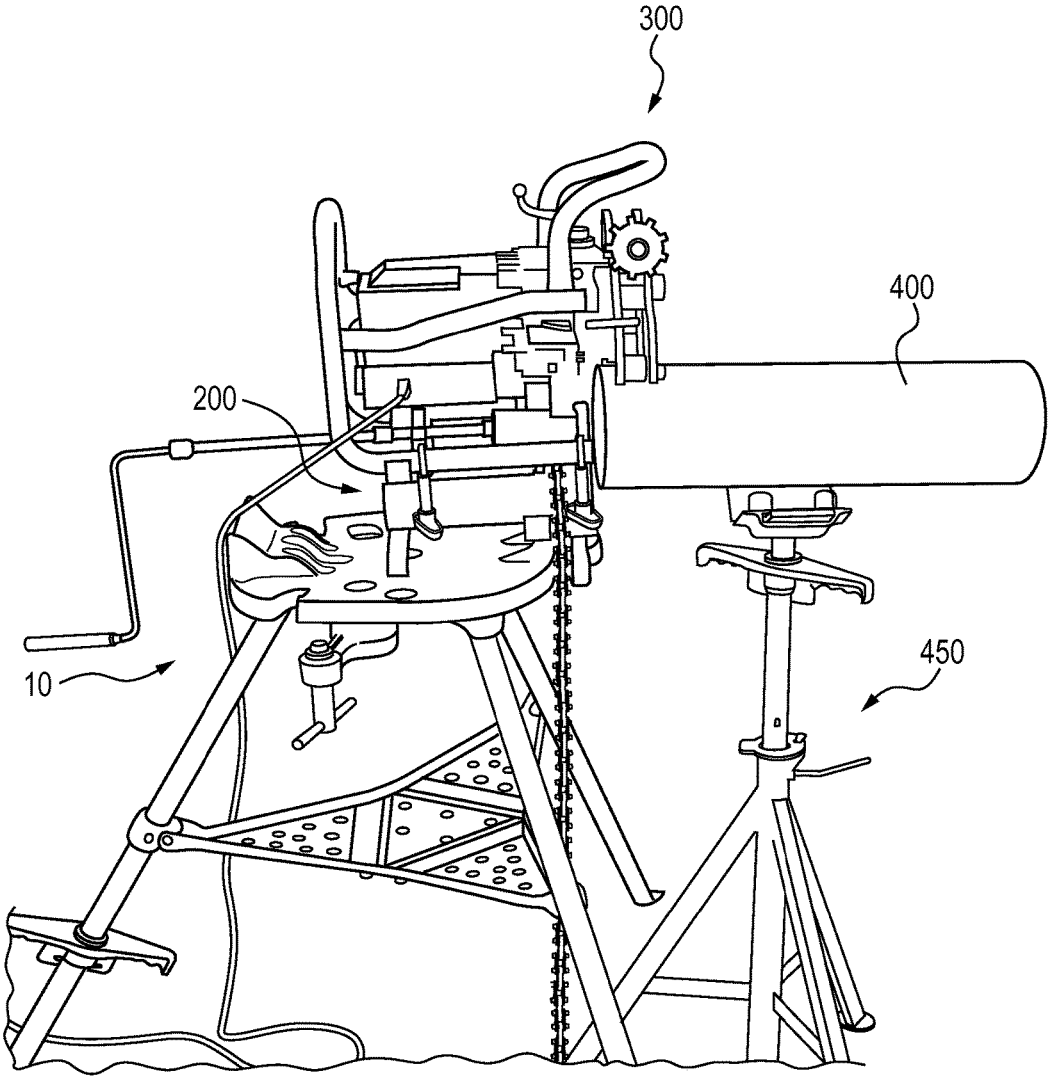
FIG. 9 illustrates use of the beveller tool mounted on a TRISTAND chain vise using the adapter of FIG. 3, and beveling a pipe or other workpiece.

FIG. 9 illustrates use of the beveling tool 300 while stably mounted on the TRISTAND chain vise 10 using the adapter 200 in accordance with the present subject matter. As will be understood, the tool 300 can be used to bevel or otherwise shape or modify an end of a workpiece such as workpiece 400 as shown. One or more supports such as support 450 can be used to support the workpiece 400.

Figure 10:
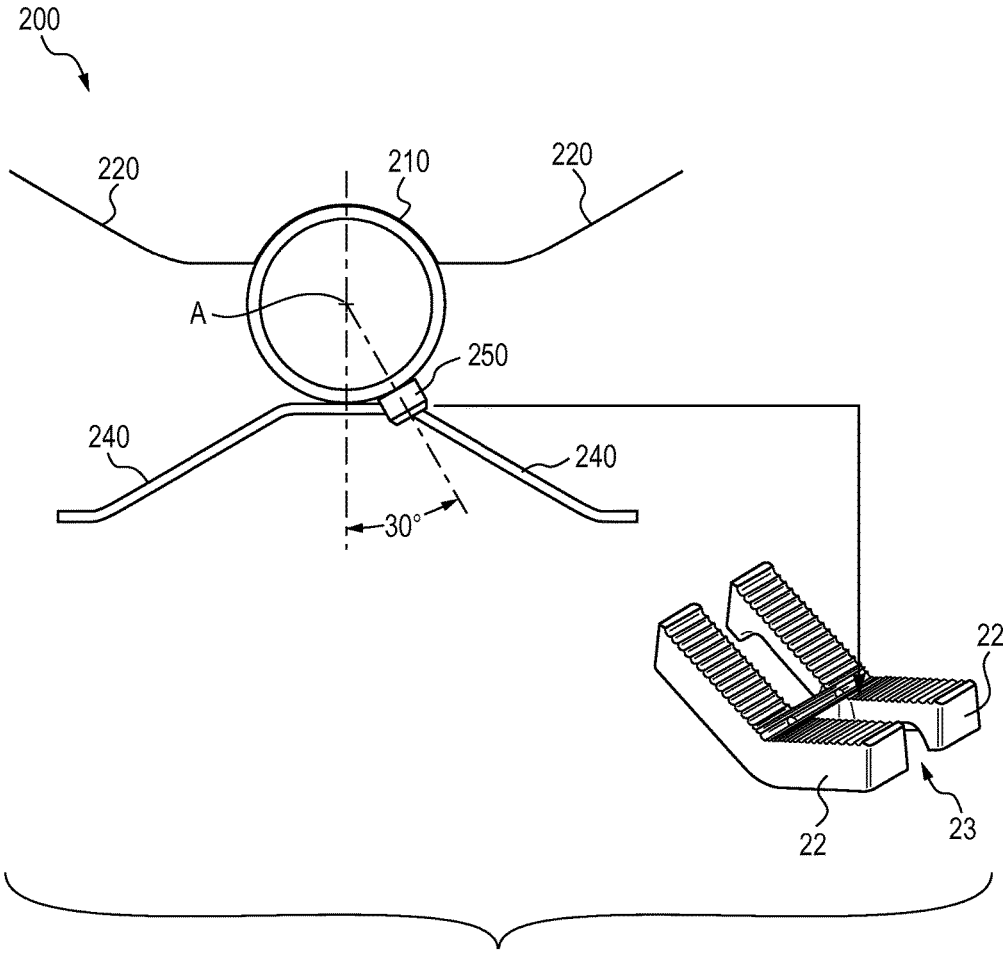
FIG. 10 schematically depicts an optional key component which can be included in the adapters.

FIG. 10 schematically illustrates an optional key 250 that can be included in the adapters of the present subject matter. For chain pipe vises utilizing a V-shaped support 22 having a void or space 23 between adjacent co-extending leg sections of the support 22 as depicted in FIG. 10, the adapter 200 can include a key 250 extending outward from the stanchion 210. Upon appropriate positioning and orientation of the adapter 200 on the V-shaped support 22, the key 250 is positioned within the space 23 between adjacent legs of the support 22. Such positioning further promotes stability between the adapter 200 and the chain pipe vise once the adapter 200 is affixed thereto. In particular, the outwardly extending key 250 prevents longitudinal movement of the adapter 200 along axis A of the stanchion 210 relative to the V-shaped support 22. It will be appreciated that other structural features could be used instead of, or in addition to, the one or more key(s) as described herein. The key 250 can extend outward from the stanchion 210 in a variety of different orientations and directions. However, a useful orientation is for the key 250 to extend outward from the center axis A of the stanchion 210 at an angle of from about 20° to about 40°, with 30° (relative to vertical as shown) being suitable for most applications.

Figure 11:
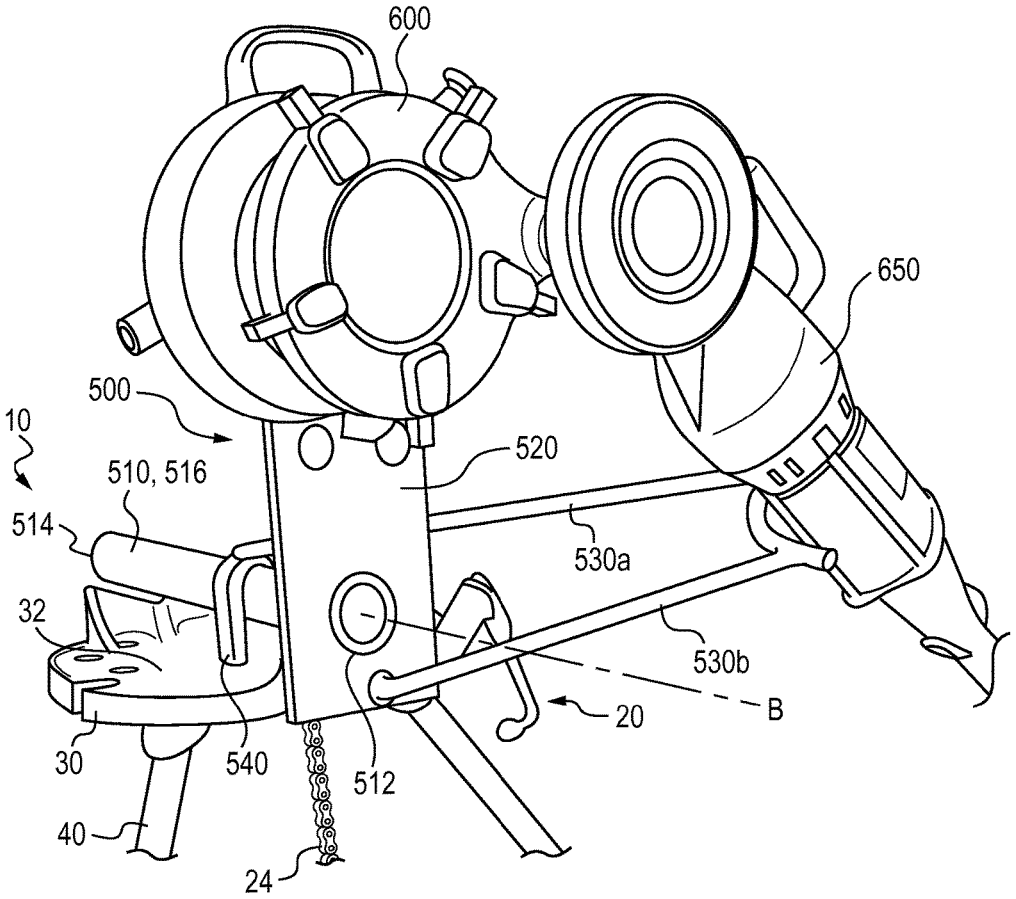
FIG. 11 illustrates use of another embodiment of an adapter affixed in a TRISTAND chain vise in accordance with the present subject matter.
Figure 12:
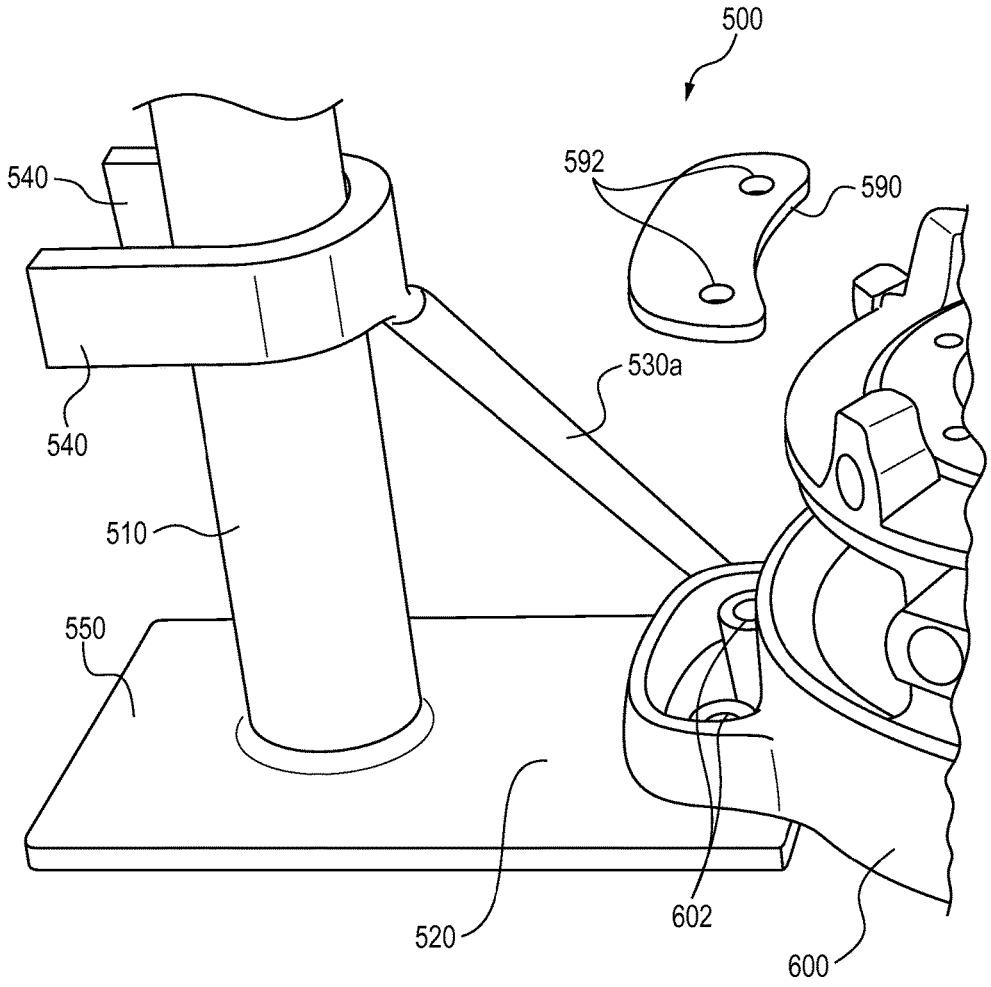
FIG. 12 illustrates a detailed view of the adapter depicted in FIG. 11.

FIGS. 11 and 12 illustrate another embodiment of an adapter 500 engaged in a chain pipe vise 20 of a TRISTAND chain vise 10. The chain pipe vise 20 and TRISTAND chain vise 10 are as previously described with regard to FIG. 1.

The adapter 500 is configured to mount a tool system which can for example include a threading die 600 and a power drive 650 to the TRISTAND chain vise 10. The adapter 500 includes a stanchion 510 defining a first end 512, a second opposite end 514, and an exterior surface 516. The stanchion 510 may be hollow and in the form of a cylindrical tube. The stanchion 510 is positioned on the V-shaped support (not shown) as previously described for FIGS. 4 and 5. The adapter 500 includes a single support 520 extending outward from the stanchion 510. The support 520 generally extends outward at right angles or substantially so to a center axis of the stanchion 510 shown in FIG. 11 as axis B. Upon positioning the adapter 500 in a chain pipe vise, generally the support 520 extends upward or upward at an angle or inclination. In the particular embodiment under discussion, the support 520 is engaged or affixed to the threading die 600 by one or more threaded fasteners such as bolts for example. As will be understood, the power drive 650 mounts in a conventional fashion to the threading die 600.

The adapter 500 also includes one or more couplings 530 for supporting a tool or tool system, which in the embodiment of FIGS. 11 and 12, is the power drive 650. The couplings 530 serve to support the power drive 650 engaged to the adapter 500. The couplings 530 prevent movement of the power drive 650 relative to the TRISTAND chain vise 10 and the threading die 600. In certain embodiments, the couplings 530 can include releasable affixment provisions to further engage the couplings to a tool or portion of a tool. For example, it may be desirable to provide a C-shaped bracket at the distal end of one or more couplings 530 that can be positioned about the body of a power drive.

The adapter 500 also includes legs 540 extending from the stanchion 510. In the particular version of FIGS. 11 and 12, the adapter 500 includes two legs 540 that extend downward from the stanchion 510 and contact the work surface 32 of the TRISTAND chain vise 10 upon appropriately positioning the adapter 500 with the chain pipe vise 20.

FIG. 12 further illustrates one of the couplings shown as coupling 530*a* for supporting and/or engaging the power drive 650 of the tool system to be affixed and engaged in the TRISTAND chain vise 10. As also depicted in FIG. 12, the adapter 500 can also include a plate 590 defining one or more apertures 592. The plate 590 is shaped and configured to be positioned over mounting provisions 602 of the support 520. Upon alignment of the plate 590 and its apertures 592 with the mounting provisions 602, one or more bolts or threaded fasteners for example can be inserted through the apertures 592 and threadedly engaged in the provisions 602 to thereby affix the threading die 600 to the support 520 of the adapter 500.

FIG. 12 also depicts a downwardly extending portion 550 of the support 520 which can function similarly as the previously described key 250. The term "downwardly extending" refers to when the adapter 500 is appropriately positioned with the chain pipe vise 20. In this embodiment of the adapter 500, the lower portion 550 of the support 520 serves to axially locate the adapter in the chain pipe vise 20 by contact occurring between the portion 550 and the V-shaped support 22, other portions of the chain pipe vise 20, and/or the base plate 30 of the TRISTAND chain vise 10.

Many other benefits will no doubt become apparent from future application and development of this technology.

All patents, applications, standards, and articles noted herein are hereby incorporated by reference in their entirety.

The present subject matter includes all operable combinations of features and aspects described herein. Thus, for example if one feature is described in association with an embodiment and another feature is described in association with another embodiment, it will be understood that the present subject matter includes embodiments having a combination of these features.

As described hereinabove, the present subject matter solves many problems associated with previous strategies, systems and/or devices. However, it will be appreciated that various changes in the details, materials and arrangements of components, which have been herein described and illustrated in order to explain the nature of the present subject matter, may be made by those skilled in the art without departing from the principle and scope of the claimed subject matter, as expressed in the appended claims.

What is claimed is:

1. An adapter for mounting a tool to a chain vise, the adapter comprising:

a stanchion defining a first end and a second opposite end;

at least one leg extending outward from the stanchion;

a key extending outward from the stanchion, wherein the key extends outward from a center axis of the stanchion at an angle of from 20° to 40°;

wherein the stanchion is sized and shaped to be received and engaged with the chain vise, and the leg is configured to contact a support surface associated with the chain vise.

2. The adapter of claim 1 further comprising:

at least one support, each support extending laterally outward from the stanchion, each support defining a distal end.

3. The adapter of claim 2 further comprising:

at least one adjustable coupling, each coupling engaged at the distal end of a respective support.

4. The adapter of claim 2 wherein each support extends transverse to a center axis of the stanchion.

5. The adapter of claim 3 wherein each adjustable coupling includes a mount engaged at the distal end of a respective support and a linearly displaceable member engaged with the mount.

6. The adapter of claim 5 wherein the linearly displaceable member includes a handle and an engagement end for affixment to a tool.

7. The adapter of claim 1 wherein the key extends outward from the stanchion such that upon proper axial placement of the adapter relative to the chain vise, the key contacts the chain vise.

8. The adapter of claim 1 wherein the adapter is integral with a tool.

* * * * *